US007293436B2

(12) United States Patent
No et al.

(10) Patent No.: US 7,293,436 B2
(45) Date of Patent: Nov. 13, 2007

(54) WATER SUPPLY ASSEMBLY OF WASHING MACHINE

(75) Inventors: Yang Hwan No, Changwon-si (KR); Jong Seok Kim, Changwon-si (KR); Han Ki Cho, Changwon-si (KR); Yeon Su Jung, Changwon-si (KR); Jung Hoon Kang, Changwon-si (KR); Young Hoon Ha, Masan-si (KR); Myung Sik Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 426 days.

(21) Appl. No.: 10/717,936

(22) Filed: Nov. 21, 2003

(65) Prior Publication Data

US 2004/0148975 A1 Aug. 5, 2004

(30) Foreign Application Priority Data

Nov. 28, 2002 (KR) ..... 10-2002-0075051

(51) Int. Cl.

| | |
|---|---|
| ***D06F 3/00*** | (2006.01) |
| ***D06F 33/00*** | (2006.01) |
| ***D06F 29/00*** | (2006.01) |
| ***D06F 35/00*** | (2006.01) |
| ***D06F 39/04*** | (2006.01) |
| ***D06F 39/08*** | (2006.01) |
| *B08B 3/00* | (2006.01) |
| *B08B 3/04* | (2006.01) |

(52) U.S. Cl. ..... 68/17 R; 68/12.01; 68/12.18; 68/12.19; 68/12.23; 68/13 R; 68/147; 68/148; 134/84; 134/104.1; 134/104.2; 134/166 R

(58) Field of Classification Search ..... 68/12.01, 68/12.18, 12.19, 12.23, 13 R, 17 R, 147, 68/148; 134/84, 104.1, 104.2, 166 R; 141/133
See application file for complete search history.

(56) References Cited

U.S. PATENT DOCUMENTS 3,896,641 A * 7/1975 Worst ..... 68/17 R
6,125,881 A * 10/2000 Hobbs et al. ..... 137/360

FOREIGN PATENT DOCUMENTS

JP 10-263282 10/1998
KR 10-2001-0037672 5/2001

* cited by examiner

*Primary Examiner*—M. Kornakov
*Assistant Examiner*—Rita R Patel
(74) *Attorney, Agent, or Firm*—Ked & Associates, LLP

(57) ABSTRACT

An improved water supply assembly for a washing machine is provided which prevents breakage of a water supply hose due to freezing. The water supply assembly includes a detergent box assembly provided in a cabinet so as to communicate with a tub of the washing machine, and a water supply valve assembly connected to the detergent box assembly by a hose so as to control a flow of water into the washing machine. By positioning the water supply valve assembly higher than the detergent box, the hose extending therebetween is oriented at a downward slant, thus causing any excess water remaining in the hose after the flow of water into the washing machine has been cut off to naturally drain into the detergent box assembly.

21 Claims, 5 Drawing Sheets

WATER SUPPLY ASSEMBLY OF WASHING MACHINE

This application claims the benefit of Korean Application (s) No. 10-2002-0075051 filed on Nov. 28, 2002, which is/are hereby incorporated by reference.

BACKGROUND OF THE INVENTION

1. Field of the Invention

The present invention relates to a washing machine, and more particularly, to a water supply assembly of a washing machine for preventing a hose, which connects a detergent box assembly to a water supply valve assembly, from being frozen to breakage.

2. Discussion of the Related Art

Generally, a washing machine is an apparatus for eliminating dirt or filth attached to a laundry using reaction between water and detergent.

Such a washing machine is classified into a pulsator type, an agitator type, and a drum type. The agitator type washing machine rotates an agitator protruding from a bottom center of a tub in forward and reverse directions to perform washing. The pulsator type washing machine rotates a disc-type pulsator on a bottom of a tub in forward and reverse directions to perform washing using a frictional force between a generated current and a laundry. And, the drum type washing machine rotates a drum holding water, detergent, and laundry at low speed to perform washing. In this case, a plurality of tumbling ribs protrude from an inside of the tub.

The drum type washing machine is superior to other type washing machines in preventing damage and entanglement of laundry, thereby being widely used lately. FIG. 1 is a cross-sectional view of a general drum type washing machine. A construction of a general drum type washing machine is explained by referring to FIG. 1 as follows.

A tub 2 is provided in a cabinet 1 and a drum 3 is rotatably installed in the tub 2. And, a motor 4 is installed in rear of the tub 2 in the cabinet 1 to rotate the drum 3. A door 5 is provided on a front side of the cabinet 1, and a control panel 6 is provided over the door 5. A drain assembly 8 for discharging water in the tub 2 outside is provided under the tub 2. And, a water supply assembly 7 for supplying water and detergent to the tub 2 is provided over the tub 2.

Meanwhile, FIG. 2 is a perspective view of a washing machine having a top plate removed to show a water supply assembly in FIG. 1.

Referring to FIG. 2, a water supply assembly 7 consists of a water supply valve assembly 7*a*, a detergent box assembly 7*b*, and first and second hoses 7*d* and 7*c*.

The water supply valve assembly 7*a* is installed inside a rear wall of the cabinet 1, and the detergent box assembly 7*b* is provided inside a front wall of the cabinet 1. In this case, the detergent box assembly 7*b* consists of a housing 7*f* fixed to the cabinet 1 and a container 7*g* inserted/separated in/from the housing 7*f*.

Meanwhile, the first hose 7*d* penetrates into the cabinet 1 and is then connected to the water supply valve assembly 7*a* and the second hose 7*c* connects the detergent box assembly 7*b* and the water supply valve assembly 7*a* to each other.

In the above-constructed general washing machine, the water supply valve assembly 7*a* is provided as high as the detergent box assembly 7*b*, and the second hose 7*c* is installed to connect them to each other. Hence, even if the water supply valve assembly 7*a* cuts off water flowing from the first hose 7*d*, the water remains in the second hose 7*c*. Hence, a middle portion of the second hose 7*c* droops down and the remaining water gathers in the drooping portion. The water remaining in the second hose 7*c* becomes frozen at low temperature, whereby the second hose 7*c* is frozen to breakage.

Moreover, in the above-constructed general washing machine, water supply valves constructing the water supply valve assembly 7*a* are screw-fixed to the rear wall of the cabinet 1. Hence, it is difficult to install the water supply valves at accurate positions. And, time is wasted for the corresponding work.

SUMMARY OF THE INVENTION

Accordingly, the present invention is directed to a water supply assembly of a washing machine that substantially obviates one or more of the problems due to limitations and disadvantages of the related art.

An object of the present invention, which has been devised to solve the foregoing problem, lies in providing a water supply assembly of a washing machine, which prevents a hose, which connects a detergent box assembly to a water supply valve assembly, from being frozen to breakage.

It is another object of the present invention to provide a water supply assembly of a washing machine, in which a water supply valve assembly easily installed.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a water supply assembly of a washing machine including a detergent box assembly in a cabinet to communicate with a tub, a water supply valve assembly provided higher than the detergent box assembly to control a passage of water flowing inside, and a hose provided slant to connect the detergent box assembly to the water supply valve assembly.

In another aspect of the present invention, there is provided a washing machine including a cabinet having an upper side covered with a top plate, a tub in the cabinet, a drum rotatably provided in the tub, a detergent box assembly in the cabinet to communicate with the tub, a water supply valve assembly provided higher than the detergent box assembly, the water supply valve connected to the detergent box assembly via hose provided slant, the water supply valve assembly controlling a passage of water flowing inside, a drain assembly in the cabinet to communicate with the tub and to discharge the water in the tub outside, and a control panel.

In the present invention, the detergent box assembly may be provided under a top plate of the washing machine and the water supply valve assembly may be provided over the top plate. And, the control panel may be provided on the top plate. In this case, the water supply valve assembly is provided in the control panel.

Meanwhile, the water supply valve assembly may include a holder on an upper surface of the top plate and a valve fixed to the holder to be connected to the hose. In this case, the valve is arranged slant to have one side connected to the hose lower than the other side.

The holder may includes a board having one face to which the valve is fixed and first and second flanges extending from a lower side of the board in both side directions, respectively to the mounted on the upper surface of the top plate. In this case, the board may include a slant face so that one side of the valve connected to the hose is mounted lower than the other side of the valve.

Meanwhile, the first flange may be fitted to the top plate and the second flange may be screwed or bolted to the top plate. In this case, the top plate may include a bracket protruding upward for slip fit engagement of the first flange. And, the bracket is provided to enclose corners of the first flange.

In the present invention, the top plate may include a cut-away portion cut angled and a bracket having a portion neighboring to the cut-away portion protrude upward for slip fit engagement of the first flange.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 3:
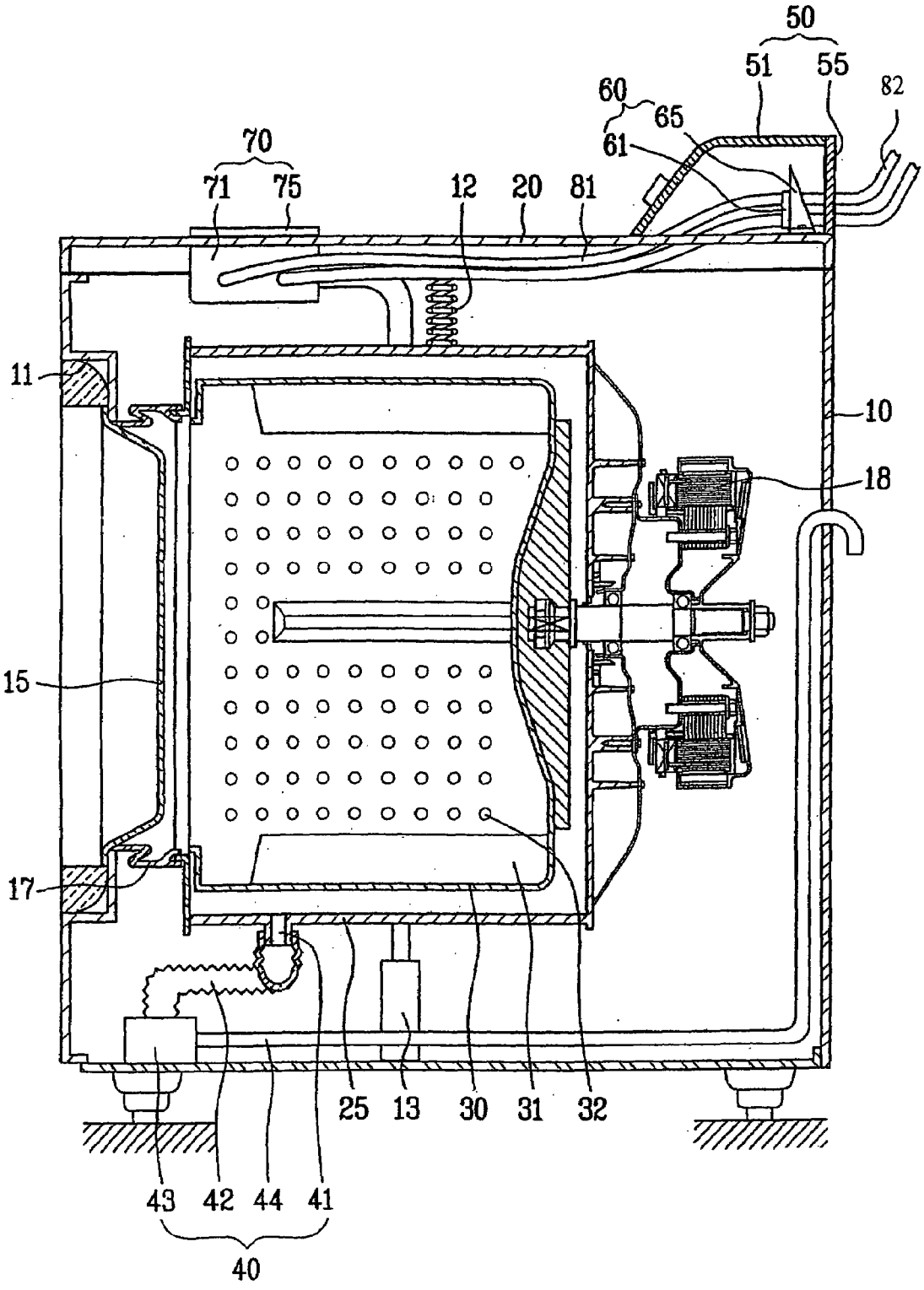
FIG. 3 is a cross-sectional view of a drum type washing machine according to the present invention.

FIG. 3 is a cross-sectional view of a drum type washing machine according to the present invention.

Referring to FIG. 3, a tub 25 is provided in a cabinet 10. The tub 25 is arranged to be suspended in the cabinet 10. For this, a plurality of elastic members, i.e., a spring 12 and a damper 13 as shown in FIG. 3, support the tub 25.

A drum 30 is rotatably provided in the tub 25. A plurality of tumbling ribs 31 protrude from an inner circumference of the drum 30 and a multitude of perforated holes 32 penetrate into an outer circumference of the drum 30, whereby water supplied in the tub 25 enables to communicate between the tub 25 and the drum 30 via the perforated holes 32.

An entrance 11 is provided at a front side of the cabinet 10 to put a laundry in/out of the drum 30. A door 15 is provided at the entrance 11 to open/close. A non-explained numeral '17' in FIG. 3 is a gasket provided between the entrance 11 and an opening of the tub 25. And, an open top of the cabinet 10 is covered with a top plate 20.

A motor 18 is installed in rear of the tub 25. A shaft of the motor 18, as shown in FIG. 3, penetrates into the tub 25 to be connected to the drum 30. Hence, once the motor 18 is driven, the drum 30 rotates in the tub 25. Meanwhile, the laundry is lifted up by the tumbling ribs 31 to fall down while the drum 30 rotates, by which frictional and shock energy is sufficiently attained for washing.

A drain assembly 40 and a water supply assembly are provided in the cabinet 10. The drain assembly 40 is for discharging water in the tub 25, and includes a bellows 42 connected to a drain 41 of the tub 25, a drain pump 43 connected to the bellows 42, and a drain hose 44 connected to the drain pump 43 to communicate with an outside.

Figure 4:
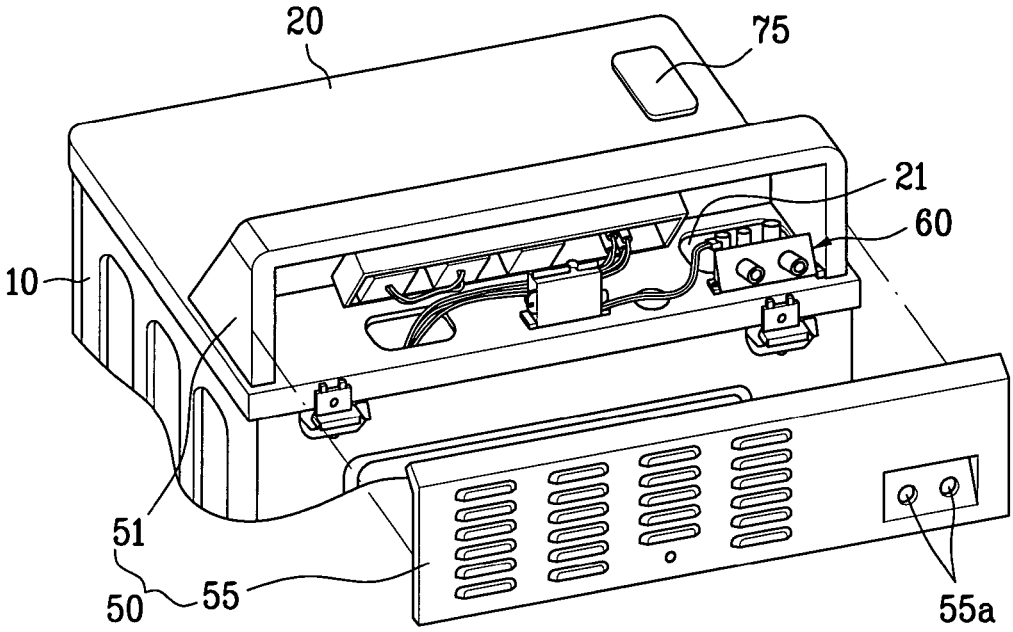
FIG. 4 is a perspective view of a washing machine having a control panel disassembled to show a water supply valve assembly in FIG. 3.

The water supply assembly is for supplying water and detergent to the tub 25, and includes a detergent box assembly 70, a water valve assembly 60, and first and second hoses 81 and 82. FIG. 4 is a perspective view of a washing machine having a control panel disassembled to show a water supply valve assembly in FIG. 3. A water supply assembly is explained by referring to FIG. 3 and FIG. 4 as follows.

Referring to FIG. 3 and FIG. 4, a water supply valve assembly 60 is disposed higher than the detergent box assembly 70. The first hose 81 lies at a slant to connect the water supply valve assembly 60 to the detergent box assembly 70. The second hose 82 for supplying the water to the water supply valve assembly 60 is connected to the water supply valve assembly 60. Hence, if the water supply valve assembly 60 cuts off a passage of water flowing in via the second hose 82, the water in the first hose 81 entirely comes into flowing in the detergent box assembly 70. This is because the water supply valve assembly 60 is disposed higher than the detergent box assembly 70 and because the first hose 81 is oriented at a slant.

In the above-constructed washing machine according to the present invention, both of the detergent box assembly 70 and the water supply valve assembly 60 can be provided in the cabinet 10. Yet, in such a case, a size of the cabinet 10 increases to give a big difference of installation height between the detergent box assembly 70 and the water supply valve assembly 60 as well as it is difficult to stably install the detergent box assembly 70 in the middle of an inside of the cabinet 10. Hence, required is a structure enabling to give a big difference of installation height between the detergent box assembly 70 and the water supply valve assembly 60 and to stably install the detergent box assembly 70 and the water supply assembly 60.

Therefore, the detergent box assembly 70, as shown in FIG. 3 and FIG. 4, is installed under the top plate 20, whereas the water supply valve assembly 60 is installed over the top plate 20. For this type of installation, the water supply valve assembly 60 installed over the top plate 20 should be covered with something. Hence, the present invention provides a structure such that the control panel 50 controlling the washing machine is installed on the top plate 20 and the water supply assembly 60 is installed inside the control panel 50.

Referring to FIG. 4, the control panel installed on the top plate 20 includes a front panel 51 and a rear panel 55. Various buttons are provided on a front side of the front panel 51 and various control parts are provided in the front panel 51. A rear side of the front panel 51 is open but is covered with the rear panel 55. And, in the rear panel 55, as shown in FIG. 4, a hole **55*a* penetrated by the second hose 82** is formed.

Figure 5:
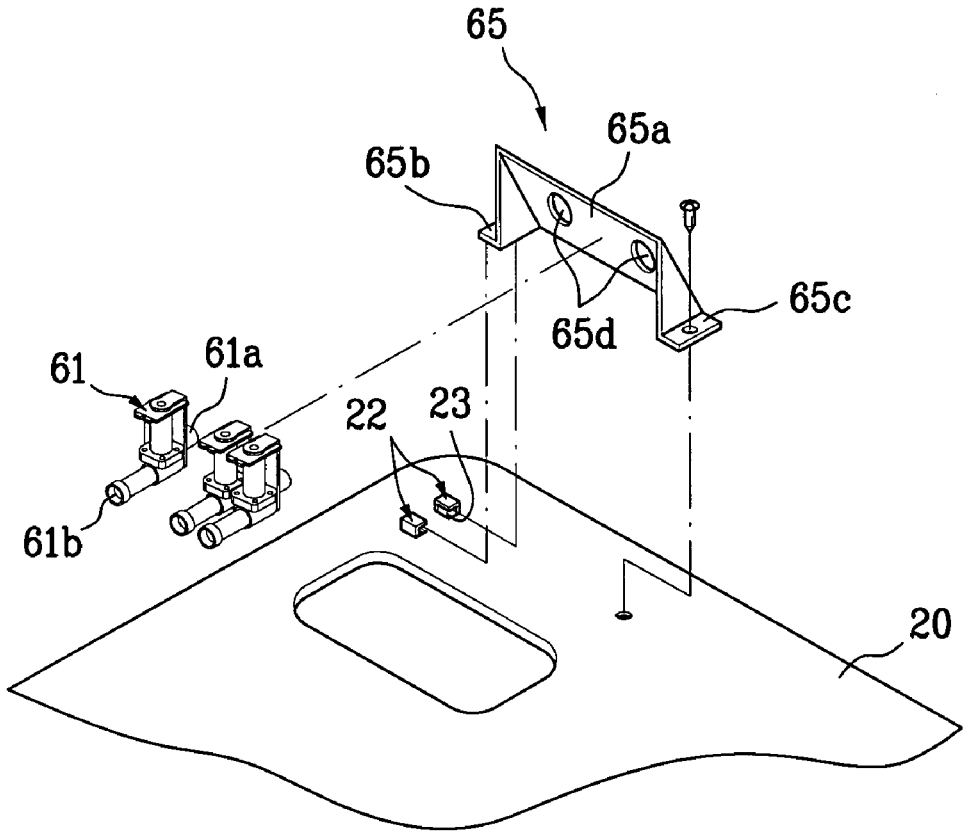
FIG. 5 is a perspective view of a water supply valve assembly of a washing machine in FIG. 3.

Moreover, in the control panel 50, the water supply valve assembly 60 is installed as well as the above parts. FIG. 5 is a perspective view of a water supply valve assembly of a washing machine in FIG. 3. The water supply valve assembly 60 is explained in detail by referring to FIG. 5.

Referring to FIG. 5, the water supply valve assembly 60 includes at least one or more water supply valves 61 and a holder 65.

The water supply valve 61 includes an outlet 61*b* connected to the first hose 81 and an inlet 65*a* connected to the second hose 82. Such a water supply valve 61 controls a flow passage of water flowing in via the second hose 82. The above-constructed water supply valve 61 is screwed or bolted to one side of the holder 65.

The first hose 81, as shown in FIG. 3, is provided slant. Hence, the inlet 61*b* of the water supply valve 61 connected to the first hose 81 is preferably provided higher than the outlet 61*a* connected to the second hose 82 to be slant.

The holder 65 is provided for installing the water supply valve 61 stably, and includes a board 65*a* and first and second flanges 65*b* and 65*c*. The inlet of the water supply valve 61 or opening 65*d* penetrated by the second hose 82 is provided at the board 65*a*. In order to provide the water supply valve 61 by slant, the board 65 having the water supply valve 61 thereon, as shown in FIG. 5, preferably has a slant surface.

The holder 65 is installed on an upper surface of the top plate 20, for which the first and second flanges 65*b* and 65*c* are used. The first and second flanges 65*b* and 65*c*, as shown in FIG. 5, extend outward from both lower side ends of the board 65*a*, respectively. The first flange 65*b* is fitted to the top plate 20, whereas the second flange 65*c* is screwed or bolted.

In order to fit the first flange 65*b* to the top plate 20, the washing machine according to the present invention is provided with a bracket 22. The bracket 22 protrudes upward from the top plate 20 for slip fit engagement of the first flange 65*b*. Of course, the bracket 22 may be separately prepared from the top plate 20 and then attached to the upper surface of the top plate 20. Yet, in order to save product cost and to simplify the process, the present invention provides a structure that the bracket 22 is built in one body of the top plate 20, which is briefly explained as follows.

A cut-away portion 23 that is cut angled is provided on the top plate 20. And, the bracket 22 is provided as a shape that a portion of the top plate 20 in the vicinity of the cut-away portion 23 protrudes upward. Such a structure can be easily implemented using a press after the cut-away portion 23 has been formed in preparing the top plate 20. Meanwhile, a pair of the brackets 22, as shown in FIG. 5, are preferably provided to enclose each corner of the first flange 65*b*.

The above-constructed water supply valve assembly 60 is installed in a following manner. First of all, the water supply valve 61 is installed at the board 65*a* of the holder 65 using screw, bolt, or the like. The first flange 65*b* of the holder 65 having the water supply valve 61 installed thereon is fitted to the bracket 22 in FIG. 5, and the second flange 65*c* is then installed on the upper surface of the top plate 20 using screw, bolt, or the like.

The water supply assembly according to the present invention can be prepared in a convenient way to improve productivity since the holder 65 is installed on the top plate 20 after the water supply valve assembly 60 has been installed on the holder 65 with a wide space. Moreover, since the screw or bolt is fastened to fix after the first flange 65*b* has been fitted to the bracket 22, the water supply valve assembly 60 can be accurately installed.

And, the first hose 81 connects the detergent box assembly 70 provided under the top plate 20 to the water supply valve assembly 60 provided over the top plate 20 by slant. Hence, the first hose 81 should penetrate into the top plate 20. Hence, a perforated hole 21, as shown in FIG. 5, is provided at a portion of the top plate 20 in the vicinity of the water supply valve assembly 60.

Figure 1:
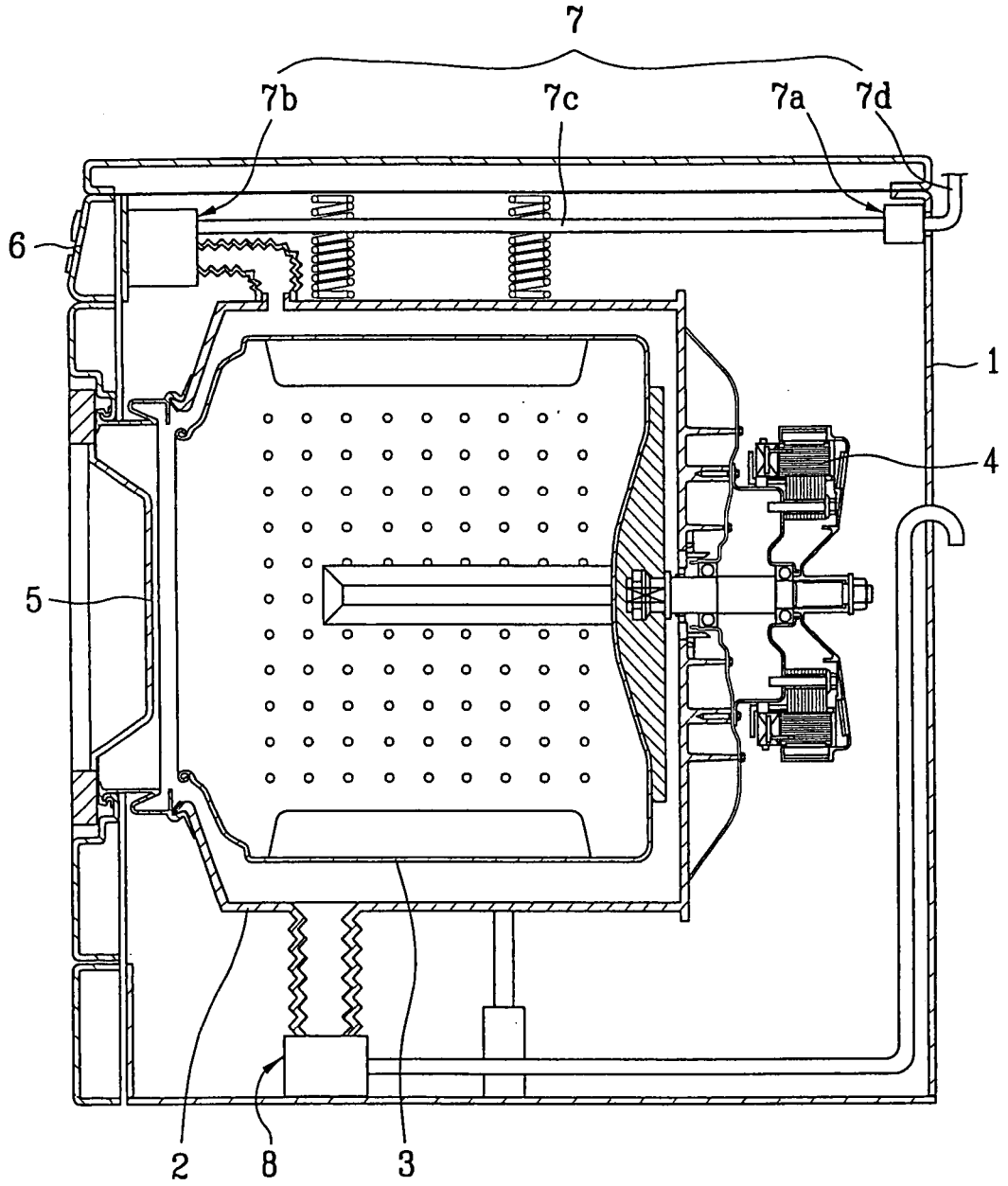
FIG. 1 PRIOR ART
FIG. 1 is a cross-sectional view of a general drum type washing machine.
Figure 2:
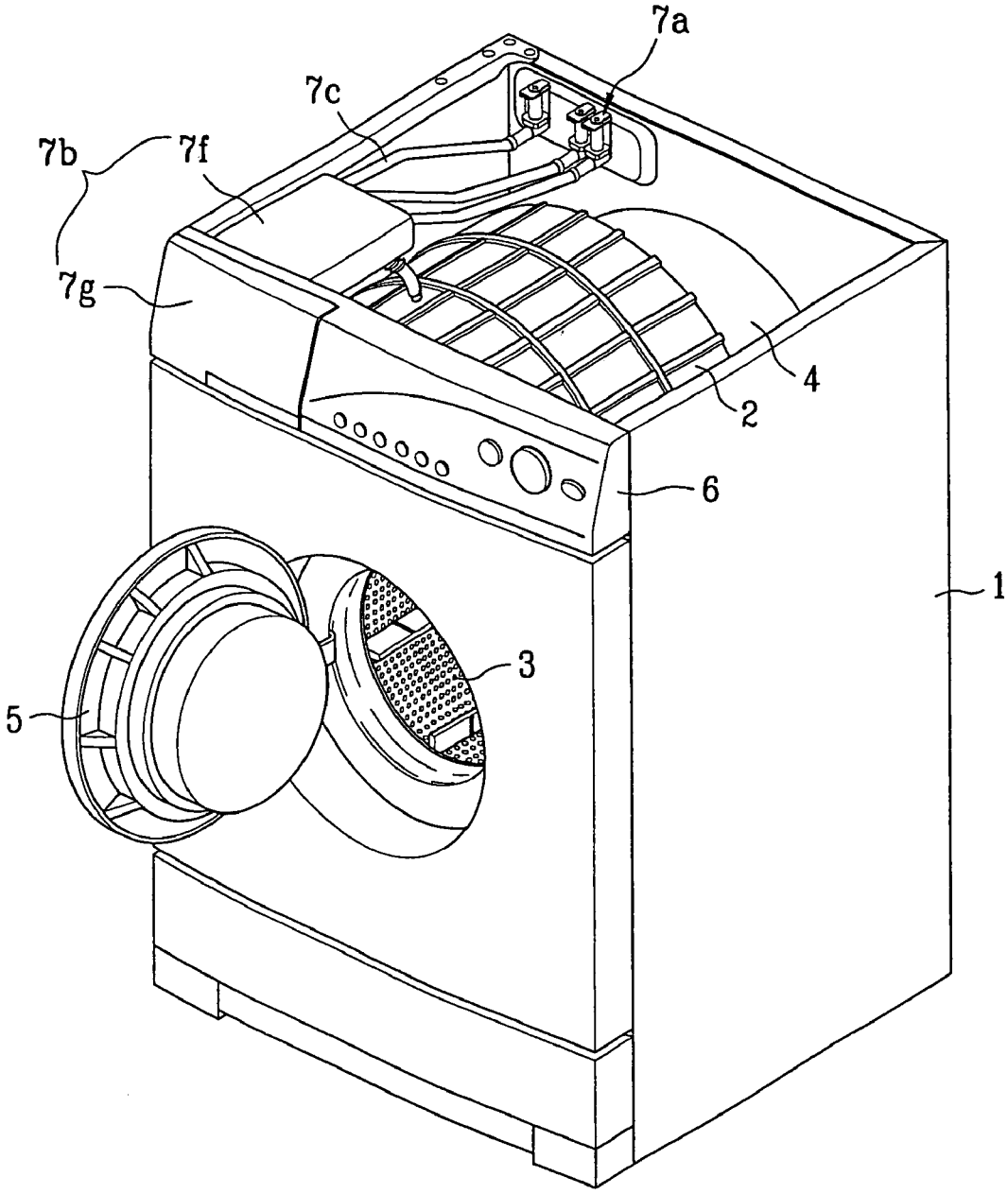
FIG. 2 PRIOR ART
FIG. 2 is a perspective view of a washing machine having a top plate removed to show a water supply assembly in FIG. 1.

Moreover, the detergent box assembly 70, as shown in FIG. 3, provided under the top plate 20 includes a container 71 and a cover 75. The container 71 is installed at a lower surface of the top plate 20 and is connected to the first hose 81. And, the container 71 is connected to an upper side of the tub 25 via bellows and the like. The cover 75 is provided to open/close an open upper side of the container 71. Meanwhile, the detergent box assembly 70 is not limited to the above-explained structure only but can also be constructed with the structure including the housing and container, as shown in FIG. 2.

Once the above-constructed washing machine according to the present invention is driven, the water supplied via the second hose 82 is supplied to the tub 25 via the water supply valve 61, first hose 81, and detergent box assembly 70. If the water supply valve 61 cuts off the passage after completion of the water supply, the water fails to flow in the first hose 81. In this case, since the water supply valve 61 is located higher than the detergent box assembly 70 and the first hose 81 is disposed slant, the water in the first hose 81 entirely comes into flowing in the detergent box assembly 70. Hence, the water fails to gather in the first hose 81. Therefore, the first hose 81 is not frozen to breakage despite cold weather.

Accordingly, the washing machine according to the present invention has the following advantages and effects.

First of all, the water supply valve 61 is located higher than the detergent box assembly 70 and the first hose 81 is disposed slant. Hence, the water fails to gather in the first hose after stopping the water supply. Therefore, the first hose is prevented from being frozen to breakage.

Secondly, the water supply valve assembly is installed in the control panel provided on the top plate. And, the water supply valve assembly includes the water supply valve and the holder. Therefore, there is no spatial limitation in assembling to provide easy work and to improve productivity.

Thirdly, when the water supply valve assembly is installed on the top plate, the holder is fixed using the screw or bolt after the first flange has been fitted to the bracket. Therefore, it is able to install the water supply valve assembly at an accurate position.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A water supply assembly for a washing machine, comprising:

a detergent box assembly positioned in communication with a tub of the washing machine;

a water supply valve assembly configured to control a supply of water to the detergent box assembly, wherein the water supply valve assembly is positioned above the detergent box assembly; and a hose configured to connect the detergent box assembly to the water supply valve assembly, wherein the hose is oriented at a downward slant from the water supply valve assembly to the detergent box assembly based on a relative vertical positioning of the water supply valve assembly and the detergent box assembly, and wherein the detergent box assembly is provided under a top plate of the washing machine and the water supply valve assembly is provided over the top plate.

2. The water supply assembly as claimed in claim 1, wherein the water supply valve assembly is provided in a control panel positioned on the top plate.

3. The water supply assembly as claimed in claim 1, wherein the water supply valve assembly comprises:

a holder configured to be positioned on an upper surface of the top plate; and a valve configured to be coupled to the holder and to be connected to the hose.

4. The water supply assembly as claimed in claim 3, wherein the valve is arranged at a slant such that a side of the valve connected to the hose is positioned lower than the opposite side of the valve.

5. The water supply assembly as claimed in claim 3, wherein the holder comprises:

a board having one face configured to be coupled to the valve; and first and second flanges extending from opposite lower sides of the board, wherein the first and second flanges are configured to be coupled to the upper surface of the top plate.

6. The water supply assembly as claimed in claim 5, wherein the board includes a face oriented at a slant such that a side of the valve connected to the hose is positioned lower than an opposite side of the valve.

7. The water supply assembly as claimed in claim 5, wherein the first flange is configured to be fitted to a bracket of the top plate and the second flange is configured to be screwed or bolted to the top plate.

8. The water supply assembly as claimed in claim 7, wherein the bracket of the top plate protrudes upward from the top plate for slip fit engagement of the first flange.

9. The water supply assembly as claimed in claim 8, wherein the bracket is configured to enclose corners of the first flange.

10. The water supply assembly as claimed in claim 7, wherein the top plate comprises an angled cut-away portion, and wherein a portion of the bracket proximate the cut-away portion protrudes upward for slip fit engagement of the first flange.

11. A washing machines comprising:

a cabinet having an upper side thereof covered with a top plate;

a tub provided in the cabinet;

a drum provided in the tub;

a detergent box assembly provided in the cabinet in communication with the tub;

a water supply valve assembly positioned above the detergent box assembly and configured to control a supply of water to the detergent box assembly, wherein the water supply valve is configured to be connected to the detergent box assembly by a hose which is oriented at a slant based on a relative positioning of the water supply assembly and the detergent box assembly, and wherein the detergent box assembly is provided under the top plate of the washing machine and the water supply valve assembly is provided over the top plate;

a drain assembly provided in the cabinet in communication with the rub and configured to discharge water from the tub to outside the washing machine; and a control panel provided on the cabinet and configured to receive at least one control component.

12. The washing machine as claimed in claim 11, wherein the control panel is provided on the top plate.

13. The washing machine as claimed in claim 12, wherein the water supply valve assembly is provided in the control panel.

14. The washing machine as claimed in claim 11, wherein the water supply valve assembly comprises:

a holder positioned on an upper surface of the top plate; and a valve configured to be coupled to the holder and to be connected to the hose.

15. The washing machine as claimed in claim 14, wherein the valve is positioned at a slant, with a side of the valve configured to be connected to the hose positioned lower than an opposite side of the valve.

16. The washing machine as claimed in claim 14, wherein the holder comprises:

a board having a face configured to be coupled to the valve; and first and second flanges extending from opposite lower sides of the board, each configured to be coupled to the upper surface of the top plate.

17. The washing machine as claimed in claim 16, wherein the face of the board is slanted such that a side of the valve configured to be connected to the hose is positioned lower than an opposite side of the valve.

18. The washing machine as claimed in claim 16, wherein the first flange is configured to be coupled to a bracket of the top plate and the second flange is configured to be screwed or bolted to the top plate.

19. The washing machine as claimed in claim 18, wherein the bracket of the top plate protrudes upward from the top plate for slip fit engagement of the first flange.

20. The washing machine as claimed in claim 19, wherein the bracket is configured to enclose corners of the first flange.

21. The washing machine as claimed in claim 17, wherein the top plate comprises:

an angled cut-away portion; and a bracket, wherein a portion of the bracket adjacent the cut-away portion protrudes upward from the top plate for slip fit engagement of the first flange.

* * * * *